United States Patent [19]

Olsen

[11] 4,050,173

[45] Sept. 27, 1977

[54] LAUNDRY FEEDING APPARATUS

[75] Inventor: Niels Johan Olsen, Akirkeby, Denmark

[73] Assignee: Firma Bora, S.A., Luxembourg

[21] Appl. No.: 610,373

[22] Filed: Sept. 4, 1975

[30] Foreign Application Priority Data

Sept. 4, 1974 Denmark ..... 4673/74

[51] Int. Cl.[2] ..... D06F 67/04

[52] U.S. Cl. ..... 38/143

[58] Field of Search ..... 38/143; 271/45, 46, 271/49, 54, 51–53, 74–76, 68–70, 79, 84, 85

[56] References Cited

U.S. PATENT DOCUMENTS

| | | | |
|---|---|---|---|
| 3,421,756 | 1/1969 | Weir | 38/143 |
| 3,604,132 | 9/1971 | Frisby et al. | 38/143 |
| 3,657,832 | 4/1972 | Valentine | 38/143 |
| 3,667,143 | 6/1972 | Hall | 38/143 |
| 3,791,057 | 2/1974 | Hall | 38/143 |

*Primary Examiner*—G. V. Larkin

*Attorney, Agent, or Firm*—Ostrolenk, Faber, Gerb & Soffen

[57] ABSTRACT

A loading station located at one side of a feeding conveyor, into which the corners of a sheet can be loaded. The station comprises two movable clamping devices supported on a track which runs across the rear of the feeding conveyor. Each clamping device is driven by an independent transmission system, the two transmission systems are connected to a selfcentering interlock mechanism. The centering mechanism is arranged to permit independent movement of the two clamping mechanisms, whereby they can move from the side position into a position in front of the feeding conveyor. The centering mechanism will then automatically control the tensioning and positioning of the leading edge of the sheet which is held by the clamping devices irrespective of the width of the sheet.

This will result in the center of the sheet being positioned in line with the required feeding center of the feed conveyor.

10 Claims, 3 Drawing Figures

LAUNDRY FEEDING APPARATUS

Figure 1:
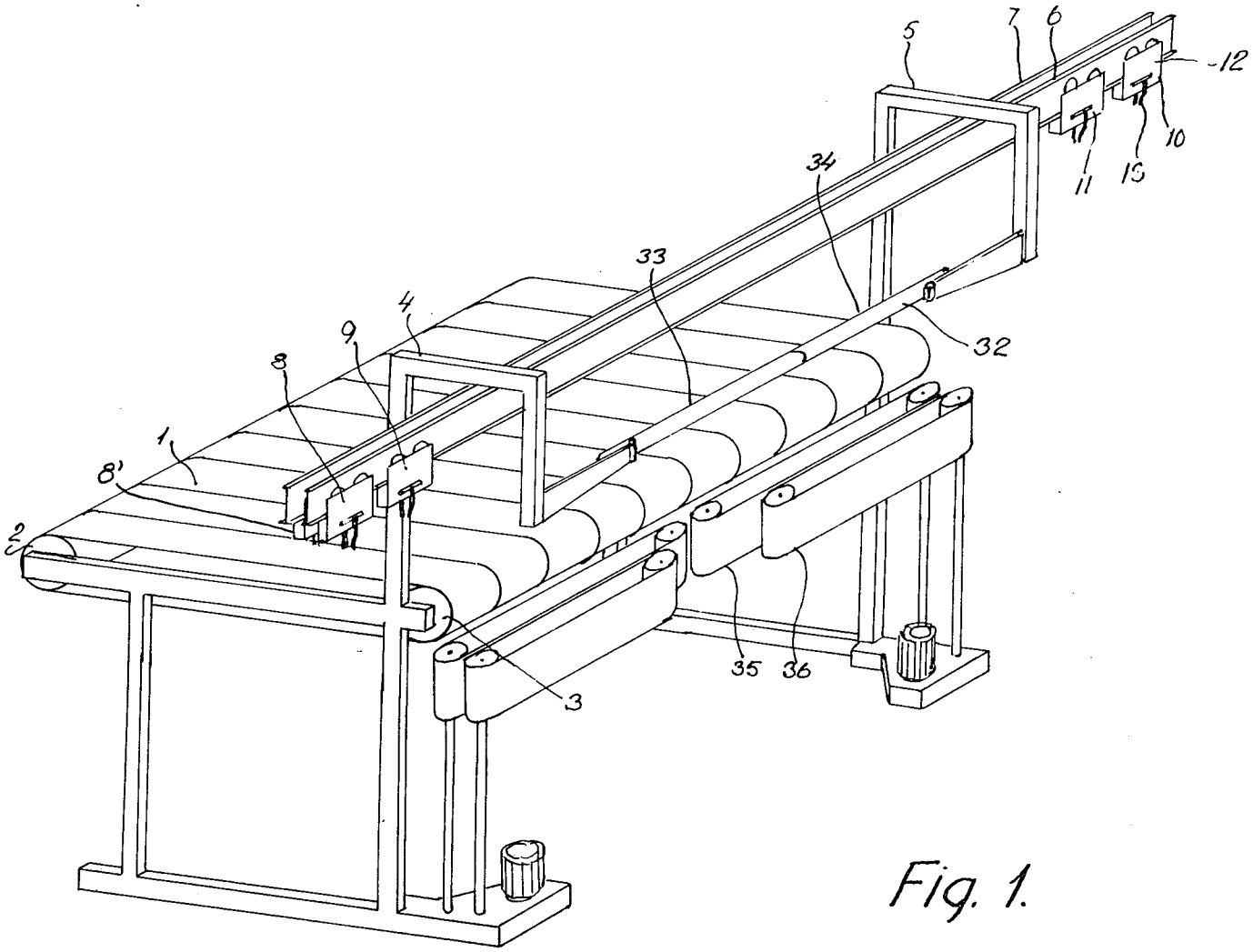

The invention relates to an apparatus for spreading and feeding pieces of laundry, such as sheets, on a conveyor. More particularly, the apparatus comprises a number of paired clamping devices, which feed and spread the pieces of laundry between the front end of a belt conveyor and the apparatus further comprise a substantially horizontally movable blade. Following release of the clamping devices each of which is holding a corner of the piece of laundry, the movable blade transfers the laundry to the belt conveyor.

A known apparatus comprises three pairs of clamping devices, which are positioned at each of three loading stations. The laundry is transferred by the clamping devices to a pair of gripper fingers at spreading section. The gripper fingers initially move apart in front of a belt conveyor, spreading the sheet of laundry to its full width. Then the gripper fingers move in the feeding direction of the conveyor and over its front end and release the sheet. The sheet is transported by the conveyor to for example an ironer.

This known apparatus has drawbacks. It is complicated in construction, and it performs a number of operations, of which some must be synchronized and others have to be coordinated in order to evenly distribute the load on the three feeding stations. Because of the complexity of its functions, this known apparatus is not able to fully use the capacity of modern ironing machines.

Modern ironing machines often have an operational speed of more than 1 m/sec. Such speed corresponds to a theoretical output of 1300 - 1800 pieces of laundry per hour, depending on the length of each piece. A trained team of 4 or 5 operators is able to manually feed up to 1000 pieces of laundry per hour, with the normal production being 800 - 900 pieces per hour.

The operational speeds of known apparatus for spreading and feeding laundry vary depending on the type and design of the apparatus. The best results until now, however, has been a speed of approximately 1000 pieces per hour. The advantage gained until now through automation of the laundry feeding process, therefore, is a reduction in the number of operators involved in feeding laundry and a reduction in the requirements as to their training and skill. Another advantage is that the pieces of laundry can be exactly centered, facilitating automation of a subsequent folding process.

In the known laundry feeder referred to above the manual work is distributed evenly between 2 or 3 operators, who have to insert 500 or 333 pieces of laundry per hour respectively in the clamping devices. In the known apparatus the speed of laundry insertion is limited by the conditions under which the operators have to work. As the laundry normally is placed behind the apparatus, the operators have to turn their bodies in order to insert the corners of each sheet in the clamping devices of each station. This turning requires ample space if the operators are not to disturb each other.

The object of the present invention is to provide an apparatus for spreading and feeding pieces of laundry on a conveyor at a speed which substantially corresponds to the capacity of a modern ironer, and which spreading apparatus is to be operated by up to four operators working at four stations arranged in such a way that the work areas of the operators do not interfere.

A further object of the invention is to provide a drive mechanism for the clamping devices of the laundry feeding apparatus, which clamping devices have small moments of inertia and are also able to position laundry at the required feeding center of the feeding conveyor.

A further object of the invention is to provide a blade mechanism that performs a smoothing action on the leading edge of each piece of laundry which is being released simultaneously with the activation of the blade.

The apparatus of the invention spreads and feeds pieces of laundry such as sheets, onto a conveyor. The apparatus comprises a number of paired clamping devices, which feed the pieces of laundry from a loading station and spreads them in a position between the front end of a belt conveyor and a substantially horizontally movable blade. The clamping devices each hold a corner of the piece of laundry. Upon release of the clamping devices from a piece of laundry, the movable blade transfers the piece of laundry to the belt conveyor. Each clamping device is driven by an independent transmission system. The two transmission systems in each pair of clamping devices are connected to a selfcentering interlock wherein further activation of the transmission system will move the clamping devices apart, spreading the leading edge of the piece of laundry before it is transferred to the conveyor.

In one embodiment of the invention each independent transmission comprises cable loops threaded over a series pulleys. One pair of groups of pulleys are mounted in a fixed position. Another pair of groups of pulleys are mounted on a sliding bar. Each sliding bar is driven by a pneumatic cylinder. One of the cable loops in a pair of clamping divide has a crossing for driving the clamping means in the same direction when the sliding bars are driven towards each other.

In another embodiment of the invention the transmission systems are arranged on two straight and parallel tracks running across and in front of the conveyor. Each track supports two pairs of clamping devices with the loading stations for the clamping devices being at the ends of the tracks. The loading stations of the two tracks are arranged face to face.

Preferably the blade comprises two blade parts each supported by a pivotable arm. The arms are arranged to move the blade parts in an arcuate outwardly directed movement over the conveyor.

Further objects and features of the invention will be apparent from the detailed description disclosing an embodiment of an apparatus according to the invention.

In the drawings

Figure 2:
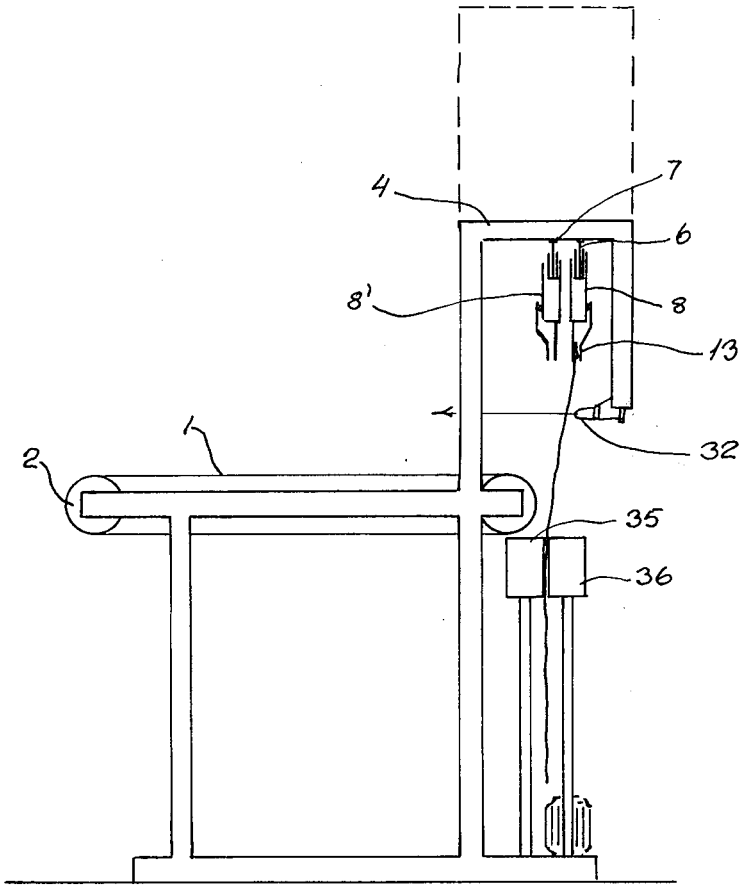
Figure 3:
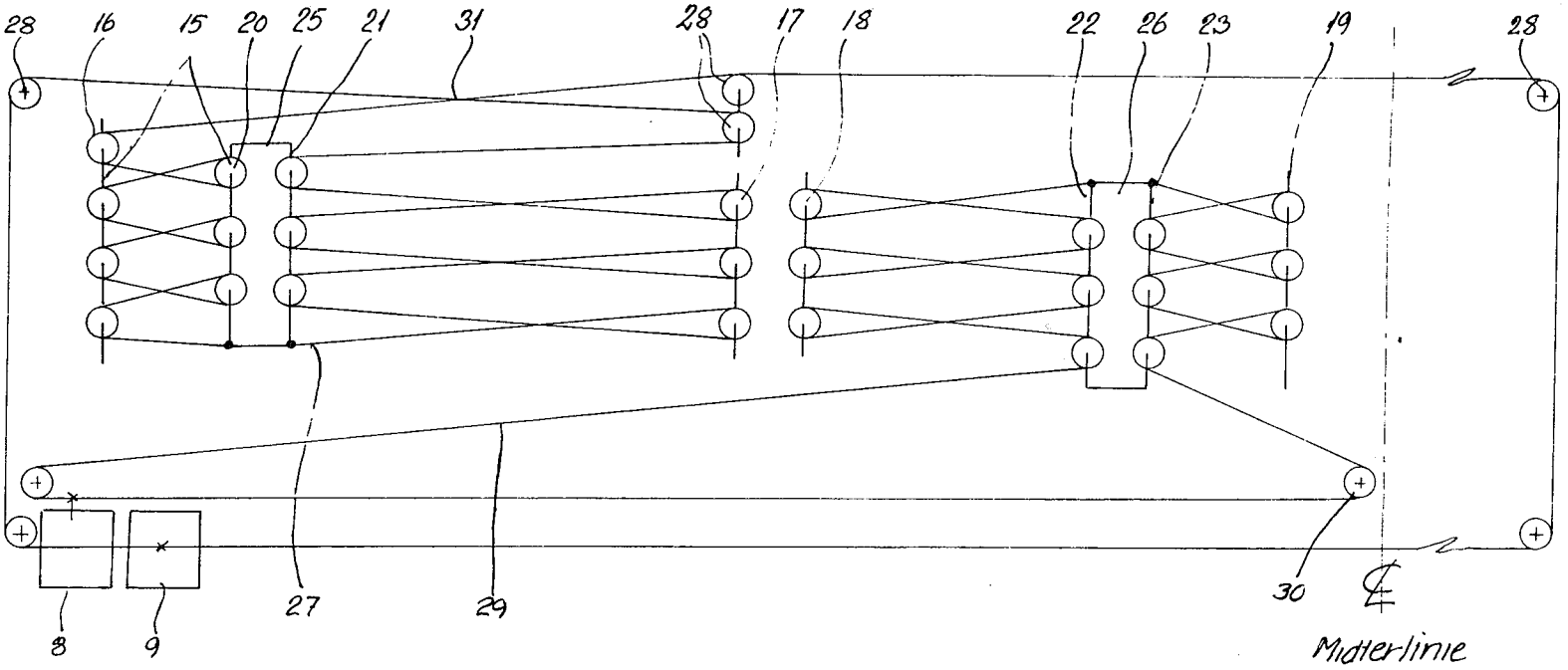

FIG. 1 shows an embodiment of the feeding and spreading apparatus in a perspective view, FIG. 2 is a traverse section view along the center line of the embodiment according to FIG. 1 and FIG. 3 shows schematically the cable operating mechanism for each pair of clamping devices.

The apparatus according to FIG. 1 comprises a conveyor 1 with two spaced apart drums 2 and 3, around which a row of parallel belts is driven. The conveyor 1 is placed in front of an ironer (not shown) in such a way that pieces of laundry which have been spread on to the conveyor 1 are fed into the ironer. At the front end of the conveyor 1 two columns 38 and 39 are mounted. These carry two tracks 6 and 7 which run parallel with and are above the front drum 3 and are in front of the conveyor. The tracks are somewhat longer than the width of the conveyor and protrudes beyond the columns 41, 42 at both sides. On each of the tracks 6 and 7 are movably mounted two pairs of clamping devices 8, 9 and 10, 11, on track 6 and 8', 9' and 10', 11' on track 7. In their non-activated positions the clamping devices rest in pairs at the ends of the tracks. These devices define a total of four loading stations placed pairwise front to front, a pair on each side of the conveyor.

Each clamping device comprises a carriage 12, on which a pair of spring-loaded gripping fingers 13 is mounted. The carriages include means for enabling them to ride along and engage the tracks 6 and 7. The gripping fingers 13 are activated by means of insertion of a corner of an article or a piece of laundry. The article is then held by the fingers until the gripping fingers 13 are separated by means of suitable releasing means, and the the article is released. The separating means are to be described later.

Above the tracks 6, 7 a transmission described below for the carriages 12 is arranged to make two distinct movements. In the first movement the carriages will travel together from the loading station to the centre of the track. Then in a second movement the carriages will move apart in opposite directions until the article suspended in the gripping fingers is spread and tensioned. Preferably, this relative movement of the carriages is such that the article is spread exactly symmetrically with respect to the centre line of the conveyor. The transmission may also be arranged in such a way that the spreading takes place symmetrically around some other point across the conveyor permitting simultaneous spreading of smaller articles side by side on each half of the conveyor.

The transmission may be constructed in several ways. The preferred embodiment is driven pneumatically and its movements are transferred by means of cables which are threaded on a series of narrow, grooved pulleys in such a way that a short movement of a pneumatic piston cylinder combination is transformed into a long fast movement, but with less power. In FIG. 3 the cable arrangement for moving two clamping devices 8 and 9 is shown schematically. Two pneumatic cylinders 41 and 42 are arranged to drive the pair of carriages of the two clamping devices in such a way that each cylinder drives one carriage in a separate transmission system. The arrangement in FIG. 3 shows how two transmission systems are arranged so that the relative movement spreading the article or sheet is always symetrical with respect to a predetermined point on the track, normally the centreline of the apparatus.

The cable arrangement comprises eight groups of pulleys 15, of which four groups of pulleys 16, 17, 18, 19 are mounted in a fixed position, the other four groups 20, 21, 22, 23 being movably mounted. The groups 20 and 21 are mounted on a first sliding bar 25. The groups 22 and 23 are mounted on a second sliding bar 26. Affixed to the first sliding bar 25 there is a loop of cable 27 which is connected to the carriage of the clamping device 9. The loop 27 is threaded through pulleys 15, 16, 17, 21 and around a number of pulleys 28 mounted at fixed positions. The other carriage of the clamping device 8 is connected with a second loop of cable 29. Loop 29 is threaded through pulleys 18,19,22,23 and is guided around pulleys 30 mounted at fixed positions. In the preferred arrangement one of the loops 27 of cable at 31 has a crossing having the effect that a movement of the two sliding bars 25,26 in opposite directions will make the two carriages travel along the track in the same direction. Extending between the two sliding bars 25, 26 there is a pushing rod 40 of a length corresponding to the distance between the sliding bars in the predetermined centre position with the carriages close together. The two carriages of the clamping devices 8 and 9 are driven by separate respective pneumatic cylinders 41 and 42.

The functioning of the arrangement is now described. With the two carriages 8,9 close together at a starting position corresponding to the loading station both pneumatic cylinders will be activated simultaneously. The two sliding bars approach each other as the carriages move side by side along the track in front of the conveyor. When the predetermined position, normally the centerline of the conveyor, is reached the sliding bars are in contact through the pushing rod and cannot come closer to each other. Now the cylinder moving the carriage 9 is deactivated while the other cylinder moving the carriage 8 is still activated. The sliding bar 25 pushes the other sliding bar 26 by means of the pushing rod, whereby the two carriages 8,9 will move away from each other. This movement continues until the edge of the piece of laundry by which it is suspended in the clamping devices is fully stretched. This stretched condition is sensed by means of a photo cell which activates the releasing means and activates the pneumatic cylinders to move in the opposite direction, whereby the clamping devices 8,9 return to the starting position in the loading station. The force by which the edge of the piece of laundry is stretched may be controlled, for example, by regulating the air pressure in the pneumatic system.

For each pair of clamping devices a complete transmission mechanism is provided comprising the above described pneumatic cylinders and cables. Therefore, a subsequent laundry spreading cycle with another pair of clamping devices may start its movement towards the centre of the apparatus even before the first pair of devices has returned to its starting position. This makes it possible to start a new cycle 2 to 2.5 seconds after the previous cycle.

When a piece of laundry has been spread out in front of the conveyor 1 it has to be transferred to the conveyor with the edge by which it is suspended as the leading feed edge. This is performed by means of a blade 32, arranged to perform a movement between the track and the top of the conveyor. The arrangement of the blade is seen in FIG. 2 showing a section through the apparatus. Simultaneously with the activation of the blade 32 the releasing means are also activated. The releasing means comprises a rod of the same length as the width of the conveyor. The releasing means is moved in such a way that the clipping fingers are opened against the tension of the springs, the clipping fingers being held open by means of a pawl, which may be released by inserting a piece of laundry between the clipping fingers.

The blade is preferably made in two parts, which simultaneously with the travel over the top run of the conveyor causes a brushing movement outward from the centre line. As shown in FIG. 1 the blade may comprise two telescopic parts 33,34 supported by pivoted arms 43,44 swinging around respective substantially vertical axes 45,46. Each part of the blade may be supported by two pivoted arms, or the blade may comprise telescopic parts as shown.

The blade and the releasing means are preferably driven from a common pneumatic cylinder (not shown) being mechanically interconnected in such a way that the clipping fingers are opened exactly when the blade touches the suspended and spread piece of laundry. The blade then transfers the piece of laundry to the conveyor, at the same time brushing and spreading it on the conveyor. The movement of the blade is quick, as the transfer of the piece of laundry has to be faster than the speed of the conveyor and as the blade has to return out of the way before the next piece of laundry is centered and spread out in front of the conveyor.

In each of the loading stations a contact is placed activating a system of relays and switches which in a predetermined sequence or in form of a queue activates the above described cycle. The operator just inserts two corners of a piece of laundry in the respective clamping devices and when it touches the pawl between the clipping fingers, the spring is released and the piece of laundry is held until the releasing means opens the clipping fingers. Then the piece of laundry is released. When the operator has inserted the two corners he activates the contact. The apparatus then makes a work cycle returning to the starting position ready for insertion of another piece of laundry. The functions of the apparatus are controlled by means of two photo cells, a first one sensing when the upper edge of the article is fully stretched, the second one sensing when the trailing edge is passing a predetermined point and activating the next cycle on the apparatus.

In front of the conveyor 1 two belts 35,36 are arranged. These belts have a spreading action on the pieces of laundry and spread them out in front of the conveyor. The outer sides of the belts are run in the direction towards the centre of the conveyor assisting in centering the articles before the spreading.

In some cases it may be convenient to spread the laundry manually on the conveyor. To overcome this problem the apparatus can have the beam carrying the tracks arranged in such a way that the tracks with the four loading stations are retracted over the feeding conveyor giving access to the front drum of the conveyor.

What is claimed is:

1. Apparatus for spreading and feeding pieces of laundry, comprising:

a conveyor for receiving laundry from a spreading apparatus; said conveyor having an upstream and a downstream end;

a spreading apparatus comprising at least one pair of clamping devices; each said clamping device including means for holding a piece of laundry; said clamping devices being positioned upstream of said upstream end of said conveyor and above said conveyor; clamping device moving means for moving said clamping devices of said pair thereof apart and together crosswise to the motion of said conveyor and always upstream of said conveyor;

a blade positioned further upstream from said conveyor than said clamping devices and positioned above said conveyor; said blade being movable toward said conveyor to contact the piece of laundry held by said clamping devices and to move the piece of laundry onto said conveyor.

2. Apparatus for spreading and feeding laundry of claim 1, wherein said clamping device moving means comprise a separate transmission for each said clamping device; the two said transmissions for said pair of clamping devices move said clamping devices together and apart.

3. Apparatus for spreading and feeding laundry of claim 2, wherein each said transmission comprises:

a first group of stationary pulleys; a second group of movable pulleys; a sliding bar; said second group of pulleys being mounted on said sliding bar; each said sliding bar of each said transmission of said pair of clamping devices being slidable toward and away from said sliding bar of said transmission of the other said clamping device of said pair; means for sliding said sliding bars to move toward each other and apart;

each said transmission further comprising a cable loop passing around both said first and said second pulley groups of said transmission and also being attached to the respective said clamping device, whereby said sliding bar and said clamping device moves together.

4. Apparatus for spreading and feeding laundry of claim 3, wherein said means for sliding said sliding bars comprises:

a respective pneumatic cylinder attached to each said clamping device for moving the said clamping devices and for causing the respective said sliding bar which is attached to each said clamping device to move toward the other said sliding bar of the other said clamping device of said pair.

5. Apparatus for spreading and feeding laundry of claim 4, wherein one said cable loop of the pair of said transmission cable loops of said pair of clamping devices includes a crossing in the pathway of the one said cable loop for causing motion of both said clamping devices of said pair thereof in the same direction when their said sliding bars are moving toward each other.

6. Apparatus for spreading and feeding laundry of claim 2, further comprising a plurality of said pairs of clamping devices; each said pair of clamping devices having respective said moving means.

7. Apparatus for spreading and feeding laundry of claim 6, wherein all of said clamping device moving means further comprise two straight parallel tracks extending crosswise of and being positioned above and upstream of said conveyor; each said track supporting at least one said clamping device pair.

8. Apparatus for spreading and feeding laundry of claim 7, wherein each said track has respective opposite end portions; each said track supports two said pairs of clamping devices; each said pair of clamping devices being positioned to start moving from a respective said end portion of its said track.

9. Apparatus for spreading and feeding laundry of claim 7, wherein said blade comprises two separate blade parts extending toward each other; a respective pivot arm supporting each said blade part; a respective upright support for each said pivot arm and each said pivot arm being pivotally supported to pivot about its said upright support; each said blade part being pivotable by its said pivot arm to move through an arc toward and over said conveyor.

10. Apparatus for spreading and feeding laundry of claim 1, wherein said blade comprises two separate blade parts extending toward each other; a respective pivot arm supporting each said blade part; a respective upright support for each said pivot arm and each said pivot arm being pivotally supported to pivot about its said upright support; each said blade part being pivotable by its said pivot arm to move through an arc toward and over said conveyor.

* * * * *

UNITED STATES PATENT OFFICE

CERTIFICATE OF CORRECTION

Patent No. 4,050,173 Dated September 27, 1977

Inventor(s) Niels Johan Olsen

It is certified that error appears in the above-identified patent and that said Letters Patent are hereby corrected as shown below:

On The Title Page Assignee should read -- Bora S.A. Luxembourg, Luxembourg --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*